United States Patent [19]

Honig

[11] Patent Number: 4,885,974

[45] Date of Patent: Dec. 12, 1989

[54] OVERPULSE RAILGUN ENERGY RECOVERY CIRCUIT

[75] Inventor: Emanuel M. Honig, Los Alamos

[73] Assignee: The United States of America as represented by the United States Department of Energy, Washington, D.C.

[21] Appl. No.: 655,593

[22] Filed: Sep. 28, 1984

[51] Int. Cl.[4] ..... F41F 1/02

[52] U.S. Cl. ..... 89/8; 124/3; 307/106; 307/108; 307/268; 328/67

[58] Field of Search ..... 89/8; 124/3; 310/10–14; 318/135; 307/104, 106, 107, 108, 268; 328/67; 372/25, 38; 363/124, 54, 138

[56] References Cited

U.S. PATENT DOCUMENTS

| | | | |
|---|---|---|---|
| 3,849,670 | 11/1974 | Lourigan | 307/108 |
| 3,963,945 | 6/1976 | Colyn | 328/67 X |
| 4,319,168 | 3/1982 | Kemeny | 89/8 X |
| 4,343,223 | 8/1982 | Hawke et al. | 89/8 |
| 4,406,952 | 9/1983 | Molen et al. | 328/67 X |
| 4,473,875 | 9/1984 | Parsons et al. | 307/106 X |

OTHER PUBLICATIONS

E. M. Honig, "Progress in Developing Repetitive Pulse Systems Utilizing Inductive Energy Storage", Los Alamos Nat. Lab. Report LA-UR-83-1585, Jun. 6, 1983.

J. A. Rich et al., "High Power Triggered Vacuum Gap of Rod Array Type", General Electric Report No. 81CRD321, 12/1981.

E. M. Honig, "Switching Considerations and New Transfer Circuits for Electromagnetic Launch Systems", IEEE Trans Mags., vol. 20, No. 2, pp. 312–315, Mar. 1984.

T. A. Carroll et al., "An Electromechanical Capacitor for Engery Transfer", IEEE Pub. No. 83CH1908-3, pp. 435–438, Albuquerque, NM, Jun. 6, 1983.

E. M. Honig, "Repetitive Opening Switches", Los Alamos Nat'L Lab., Report LA-UR-83-2926 (9/30/83).

*Primary Examiner*—Stephen C. Bentley

*Attorney, Agent, or Firm*—Ray G. Wilson; Paul D. Gaetjens; William R. Moser

[57] ABSTRACT

In an electromagnetic launcher such as a railgun for propelling a projectile at high velocity, an overpulse energy recovery circuit is employed to transfer stored inductive energy from a source inductor to the railgun inductance to propel the projectile down the railgun. Switching circuitry and an energy transfer capacitor are used to switch the energy back to the source inductor in readiness for a repetitive projectile propelling cycle.

9 Claims, 5 Drawing Sheets

OVERPULSE RAILGUN ENERGY RECOVERY CIRCUIT

This invention is the result of a contract with the Department of Energy (Contract No. W-7405-ENG-36).

BACKGROUND OF THE PRESENT INVENTION

The present invention relates generally to a high-power pulsing circuit and more particularly to a repetitive pulse inductive energy storage and transfer circuit for an electromagnetic launcher.

Electromagnetic launchers are generating considerable interest because their projectile launch velocities are not limited to the sonic velocity of an expanding gas, as in conventional guns. In the railgun, the simplest and most successful type of electromagnetic launcher, a projectile sliding between two parallel rails acts as a sliding switch or electrical short between them. By passing a large current down one rail, through the projectile (or a conducting sabot or plasma behind it), and back along the other rail, a large magnetic field is built up behind the projectile, accelerating it to a high velocity by the force of the current times the magnetic field. Projectile velocities over 10 kilometers per second can be obtained by this method.

Electromagnetic launchers of the railgun type have the problem that the launch process is inefficient. Even under the ideal conditions of constant-current drive and no dissipative losses, only one-half of the energy extracted from the power source is transferred to the projectile. The remainder goes into building up the magnetic field behind the projectile or, equivalently, into energizing the railgun inductance. If the energy stored in the inductance of the rails is not recovered after each launch operation, then it will be dissipated (in the rail resistance and in a muzzle blowout arc). Under these conditions, therefore, the best operational efficiency (projectile energy/power supply energy delivered) that repetitive railguns can achieve is 50 percent. Of course, dissipative losses in switches, the rail resistance, or a plasma arc behind the projectile only serve to reduce the operational efficiency below this limit.

One possibility for utilizing the inductively-stored rail energy is the breech crowbar circuit which uses a crowbar switch at the breech of the railgun to crowbar or short circuit the driving power supply when the projectile has reached some fraction of its launch velocity. Thereafter, the projectile is further accelerated by the expansion of the magnetic field trapped in the railgun behind the projectile. Unfortunately, the barrel length has to be doubled to convert one-half of the trapped magnetic energy to projectile kinetic energy and quadrupled to convert 75% of the trapped energy (assuming no dissipative losses). While technically feasible, the breech crowbar scheme results in a very large increase in railgun barrel length and never recovers all of the trapped energy.

High pulse power repetitive pulse inductive storage circuits have been disclosed in applications Ser. No. 617,653 and Ser. No. 617,658 both filed on June 5, 1984, and issued as U.S. Pat. No. 4,642,476 on Feb. 10, 1987, and U.S. Pat. No. 4,613,765 on Sept. 23, 1986, respectively. These applications illustrate some advantages of repetitive pulse indicative storage circuits and describe the type of switches that can be used therewith. These applications are incorporated by reference.

Therefore, it is an object of the present invention to provide a high-power energy transfer circuit with the capability to recover energy stored in the inductance of the load.

It is another object of the present invention to provide a repetitive energy transfer and recovery circuit.

It is another object of the present invention to provide an efficient energy transfer and recovery circuit using survivable switches.

It is still another object of the present invention to provide an energy transfer circuit for railgun electromagnetic launchers which can recover the energy from the load inductance without increasing the barrel length over that required for normal acceleration.

SUMMARY OF THE INVENTION

To achieve the foregoing and other objects, and in accordance with the purpose of the present invention, as embodied and broadly described herein, the overpulse railgun energy recovery circuit of the present invention includes a source inductor and an energy transfer capacitor coupled to the load inductance of a railgun. Switches including a muzzle switch are provided to switch stored inductive energy from the source inductor to the load inductance to fire a projectile down the railgun. The inductive energy is then switched back to the source inductor for a repetitive cycle.

An advantage of the present invention is that efficient energy recovery is provided for repetitive cycling of the railgun operation.

Another advantage of the present invention is that the railgun need not be extended to lengths greater than required for desired projectile velocity.

Still another advantage of the present invention is that it can be implemented with fewer switches, in principle, than any other known recovery circuits.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENT

Figure 1:
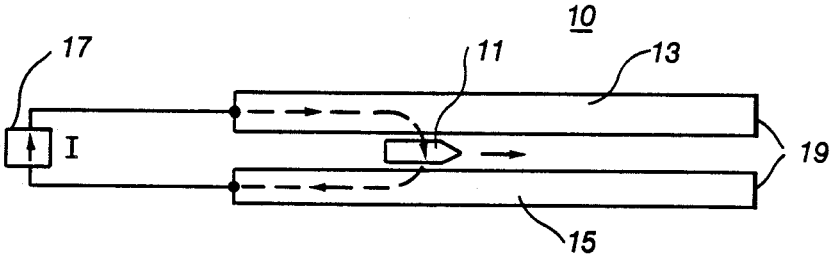
FIG. 1 is an illustration of a railgun electromagnetic launcher suitable for use with the present invention.

In accord with the present invention, an electromagnetic railgun 10 includes a projectile 11 sliding between a first rail 13 and a parallel second rail 15, see FIG. 1.

The projectile 11 acts as a sliding switch or electrical short between the rails 13 and 15. By passing a large current I generated by a current source 17 down the first rail 13 through the projectile 11 and back along the second rail 15, a large magnetic field B is built up behind the projectile 11 accelerating it to a high velocity by the IxB force. The projectile 11 will exit the railgun 10 at its muzzle end 19. A conducting projectile 11 can withstand the driving current I for only a limiting time before it will melt. Longer launch times and, therefore, higher launch velocities can be achieved if the return current path between the rails is through a plasma (not shown) confined to a small region immediately behind the projectile 11.

Figure 2:
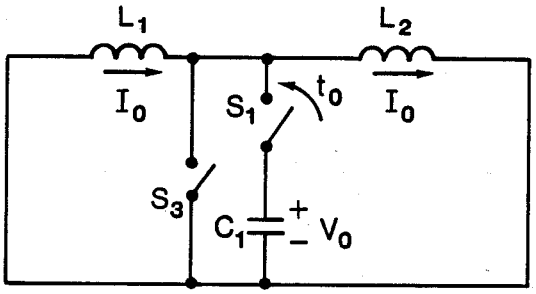
FIG. 2 is a schematic of a resonant circuit for energy recovery from a load inductance such as an electromagnetic railgun launcher.

Energy recovery in the present invention is achieved through resonant circuitry, see FIG. 2. When the projectile 11 has reached its required velocity or has exited the railgun (whichever comes first), a crowbar switch (not shown) across the muzzle end 19 of the railgun is closed. At that instant $I_0$ represents the current flowing through a storage inductor $L_1$ and the inductance $L_2$ of the railgun. By connecting at this time to a precharged transfer capactior $C_1$ across the inductor $L_1$ and inductance $L_2$, a resonant circuit condition is set up causing the current in the railgun inductance $L_2$ to oscillate through zero. Preferably the capacitor value $C_1$ and voltage $V_0$ are chosen so that the capacitive energy $E_C$ will have been expended at the same time that the load inductive energy $E_{L2}$ is zero. All the system energy can then be trapped in the storage inductor $L_1$ by closing the switch $S_3$ at the instant the energy in transfer capacitor $C_1$ and railgun inductance $L_2$ is zero.

The initial capacitive energy $E_c$ required to cause a zero current in the railgun inductance $L_2$ is given by:

$$E_c=(1+L_2/L_1)E_{L2}$$

where $E_{L2}$ is the inductive energy in $L_2$.

Figure 3:
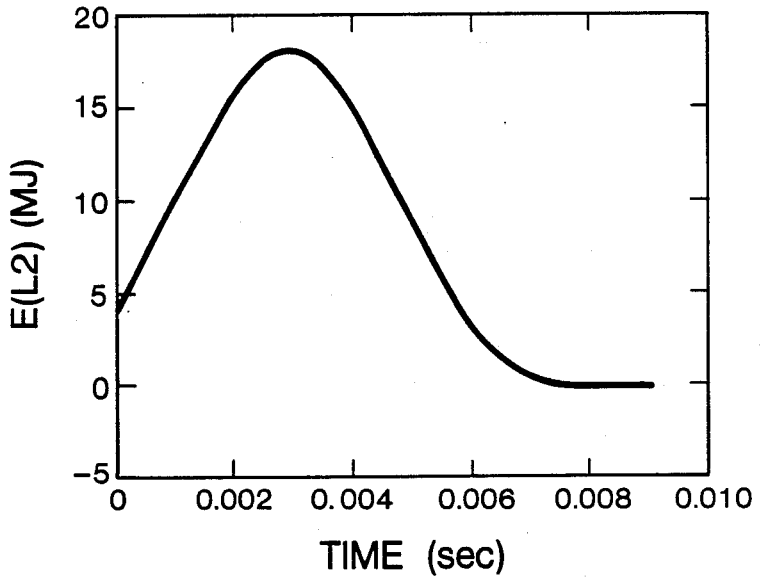
FIG. 3 is a plot of energy variation in the load inductance of FIG. 2.
Figure 4:
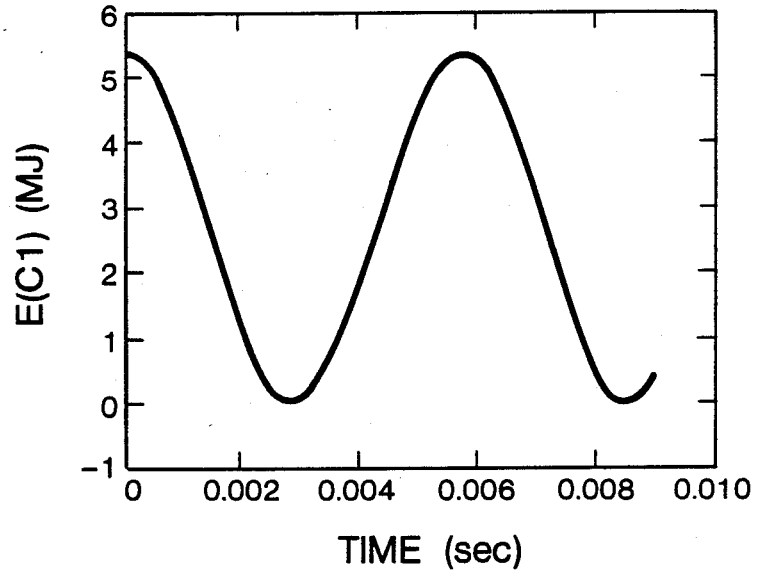
FIG. 4 is a plot of energy variation in an energy transfer capacitor used in the circuit of FIG. 2.

With $V_0$ positive and sufficient energy stored in transfer capacitor $C_1$, the current in the railgun inductance $L_2$ will first swing to a value of $2I_0$ before reversing and coming to zero. Plots of energy variation in megajoules employing this overpulse method are shown in FIG. 3 for the railgun inductance $L_2$ and FIG. 4 for the transfer capacitor $C_1$.

Figure 5:
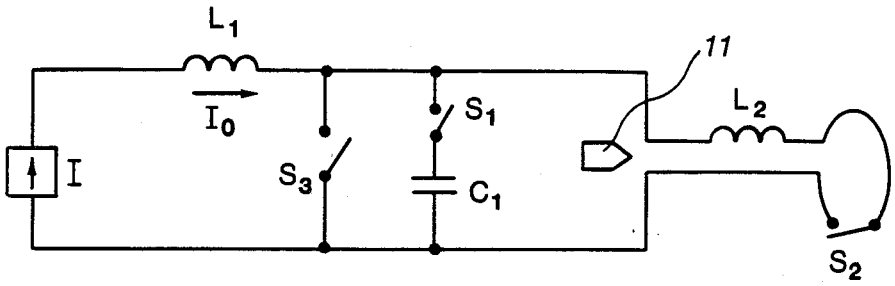
FIG. 5 is a schematic of the overpulse railgun energy recovery circuit of the present invention.

An energy transfer and recovery circuit employing the overpulse energy recovery technique of the present invention is shown in FIG. 5. A source of current I is needed to initially charge source inductor $L_1$ to $I_0$. This source of current I does not have to be an ideal current source. The storage current $I_0$ in storage inductor $L_1$ initially flows through switch $S_3$. If switch $S_3$ is a current-zero switch, then $C_1$ must have sufficient initial stored energy to provide a current counterpulse in $S_3$ and a switch $S_1$ would be required in series with the capacitor $C_1$ to provide control over counterpulse initiation. Furthermore, a load isolation switch (not shown) would have to be provided in series with the railgun 10 load to prevent counterpulse current flow through the load and to control initiation of the railgun 10 driving current. For simplicity of discussion, however, $S_3$ will be assumed to be a direct-interruption switch (similar to a dc circuit breaker or fuse) and no counterpulse is required. This does away with the need for switch $S_1$ and the load isolation switch. The capacitor $C_1$ can then be connected directly in parallel with the opening $S_3$ and the railgun 10 load and capacitor $C_1$ will not require any initial stored energy. When the projectile 11 has been injected into the railgun 10, $S_3$ is opened to force the current to transfer into transfer capacitor $C_1$ and the railgun 10. The transfer capacitor $C_1$ tracks the voltage of the railgun 10 and must be sized so that its energy at the final railgun 10 voltage will be slightly greater than that required by the above equation. The energy delivered by the storage inductor $L_1$ is divided nearly equally between the capacitor $C_1$, the railgun inductance $L_2$, and the projectile kinetic energy $E_{Projectile}$. This implies that the railgun 10 driving current must be about twice the capacitor $C_1$ current. Therefore, the storage coil current $I_0$ must be about 1.5 times the required railgun 10 driving current. When the muzzle crowbar switch $S_2$ is closed to terminate the projectile acceleration, the railgun circuit is automatically placed into the resonant overpulse condition discussed above. The transfer capacitor $C_1$ sets up an oscillation in the railgun inductance $L_2$, forcing its current to double and then swing to zero. Switch $S_3$ is then closed to trap all the circuit energy in $L_1$, returning the circuit to its original condition (minus the projectile energy) and completing one energy transfer and recovery cycle. Then the components are in condition for a repetitive cycle.

As an example, for a railgun 10 having rails 13 and 15 four meters in length with an inductance of 0.5 $\mu$H/m, a projectile mass of 2 kg, and a capacitor of 0.5 F at 2 KV. An initial current of 1.5 megamperes in the 88.9 $\mu$H storage inductor $L_1$ will supply a drive current of 1 MA to the railgun 10 and a charging current of 0.5 megampere to the capacitor $C_1$. The initial storage energy is 100 megajoules. The ratio of initial stored energy to final projectile energy of 100:1 provides for constant current during launch, simplifying the analysis of the launch process. Operational systems are likely to use a smaller storage inductor, with an energy ratio probably between 5:1 and 10:1. To compensate for the decrease in drive current during the launch, such systems would have to increase the barrel length to allow a longer launch time to achieve the same final velocity as in the constant-current case.

The above components will yield a projectile 11 launch velocity of 1 km/s with a projectile kinetic energy ($E_{projectile}$) of 1 megajoule (1 MJ). Under constant current conditions, the launch time will be 8 ms with a barrel length of 4 meters.

Figure 6:
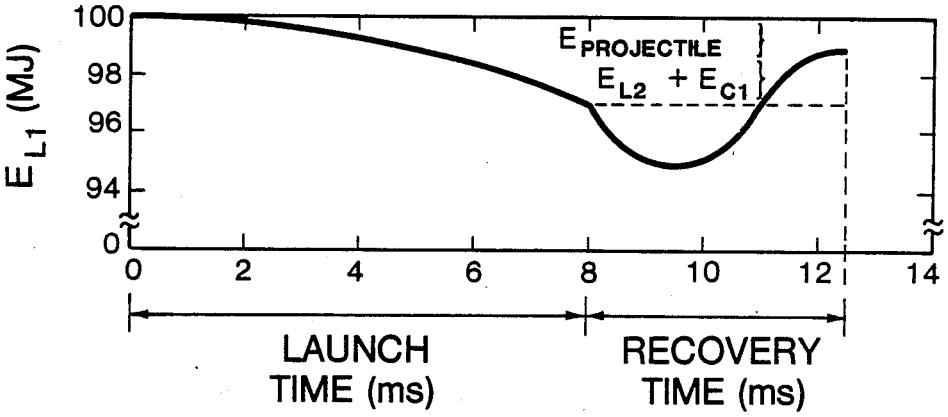
FIG. 6 is a waveform diagram of the energy in the source inductor $L_1$ in the circuit of FIG. 5.
Figure 7:
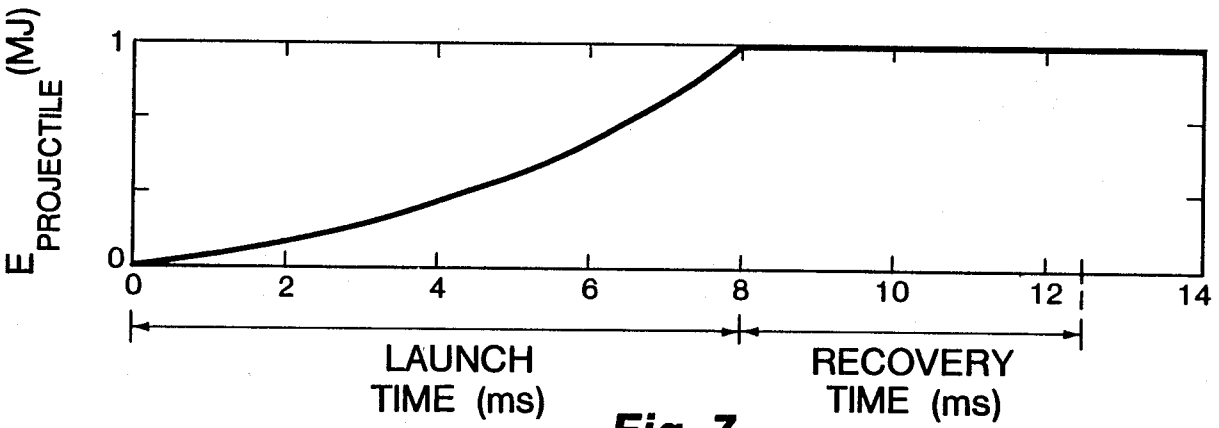
FIG. 7 is a waveform diagram of the energy in the projectile fired by the circuit of FIG. 5.
Figure 8:
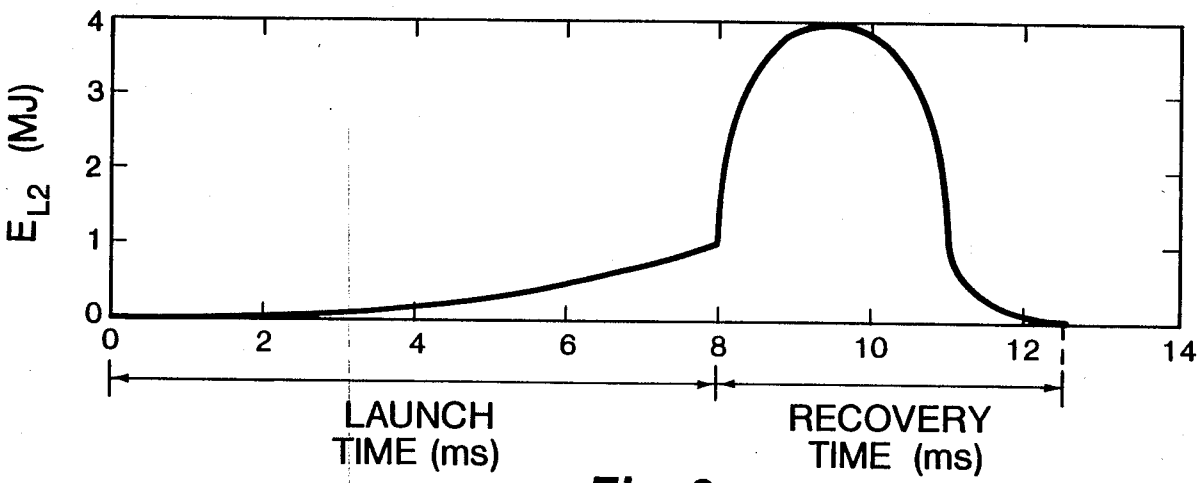
FIG. 8 is a waveform diagram of the energy in the load inductance of the circuit of FIG. 5.
Figure 9:
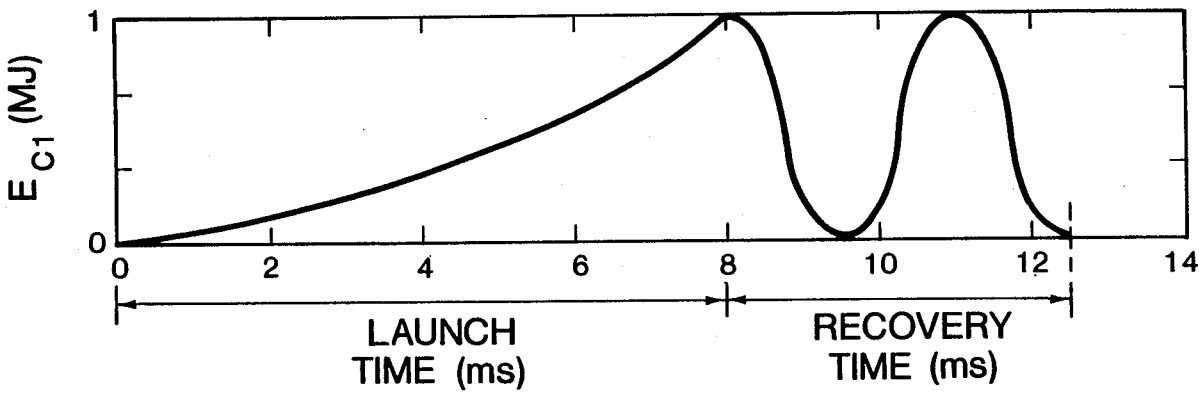
FIG. 9 is a waveform diagram of the energy in the transfer capacitor $C_1$ of the circuit of FIG. 5.

FIG. 6 shows the value of inductive energy storage $E_{L1}$ in megajoules in the storage inductor $L_1$; FIG. 7 shows the energy in megajoules of the projectile 11; FIG. 8 shows the railgun energy $E_{L2}$ in megajoules in the railgun inductance $L_2$; and FIG. 9 shows the capacitive transfer energy $E_c$ in megajoules in the transfer capacitor $C_1$.

A current-zero type switch is needed for the muzzle crowbar switch $S_2$. The rod array TVG switch is an excellent candidate for this switch since the energy recovery cycle takes only a few milliseconds. Rod array TVG's are available from the General Electric Company, see General Electric Report No. 81CRD321.

Other suitable switches are described in U.S. patent application Ser. No. 617,653 and Ser. No. 617,658 filed June 5, 1984, and issued as U.S. Pat. No. 4,642,476 on Feb. 10, 1987, and U.S. Pat. No. 4,613,765 on Sept. 23, 1986. See also, E. M. Honig, "Switching Considerations and New Transfer Circuits for Electromagnetic Launch Systems," IEEE Trans. Magnetics, Vol. MAG-20, No. 2, March 1984, pp 312–315.

The energy transfer capacitor $C_1$ may be fabricated as an electromechanical capacitor, see T. A. Carrol, P.

Chowdhuri, and J. Marshall, "An Electromechanical Capacitor for Energy Transfer," Proc. 4th IEEE Pulsed Power Conf. Albuquerque, NM, June 6–8, 1983, IEEE Pub. No. 83CH1908-3, pp. 435–438, herewith incorporated by reference.

The theoretical basis for the above described overpulse railgun energy recovery circuit is disclosed in the Los Alamos National Laboratory Report LA-10238-T, Chapter 6, herewith incorporated by reference.

The foregoing description of the preferred embodiments of the invention have been presented for purposes of illustration and description. It is not intended to be exhaustive or to limit the invention to the precise form disclosed, and obviously many modifications and variations are possible in light of the above teaching. As an example, the load is shown as a nonlinear, time-varying resistance and inductance, but the energy recovery scheme is just as applicable to loads with fixed inductances. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An overpulse railgun energy recovery circuit for propelling a projectile along a railgun, said overpulse railgun energy recovery circuit comprising:

a railgun having an effective inductance, said railgun having a breech end, a pair of parallel rails, and a muzzle end;

a source inductor for storing current connected across said pair of parallel rails of said railgun at said breech end thereof;

means for initially charging said source inductor to an initial current for storage;

switching means connected across said source inductor with a closed position for shorting across said source inducator and an open position for enabling current flow into said effective inductance of said railgun when a projectile is ready to be propelled from said breech end towards said muzzle end of said railgun;

a muzzle switch connected across said pair of parallel rails of said railgun at said muzzle end thereof, said muzzle switch having a closed position forming a closed circuit for returning said initial current minus losses to said source inductor when a projectile has exited from said muzzle end of said railgun and an open position for disconnecting said railgun effective inductance when said current has been transferred back from said effective inductance into said source inductor; and transfer capacitive means connected in parallel with said railgun inductance at said breech end thereof and with said source inductance, and having a capacitance effective to resonate with said railgun inductor and said source inductor for storing energy at a voltage developed across said railgun inductor in an amount effective to transfer energy to said railgun inductor when said muzzle switch is closed and to thereafter resonately return energy to said source inductor for storage as current for subsequent use.

2. The overpulse railgun energy recovery circuit of claim 1 wherein said ratio of said source inductor to said effective inductance of said railgun is greater than about 5:1.

3. The overpulse railgun energy recovery circuit of claim 2 wherein said ratio of said source inductor to said effective inductance of said railgun is in the order of 100:1.

4. The overpulse railgun energy recovery circuit of claim 1 wherein said effective inductance of said railgun is on the order of 0.5 $\mu$H/meter and said railgun is on the order of 4 meters from said breech end to said muzzle end.

5. The overpulse railgun energy recovery circuit of claim 4 wherein said ratio of said source inductor to said effective inductance of said railgun is greater than about 5:1.

6. The overpulse railgun energy recovery circuit of claim 1 wherein said transfer capacitive means includes a transfer capacitor.

7. The overpulse railgun energy recovery circuit of claim 6 wherein said transfer capacitor is on the order of 0.5 farads.

8. A method for recovering energy from an inductive load having an effective inductance, comprising the steps of:

storing energy as a first current in a loop having a source inductor and a first switch with a connection therebetween;

connecting said inductive load and a capacitor in parallel with said source inductor and said first switch, all joined at a common connection, said inductive load and said capacitor having no initial stored energy;

opening said first switch to develop a common voltage across said inductive load and said capacitor for transferring said stored first current energy in said source inductor to said inductive load and said capacitor;

closing a second switch adjacent said inductive load effective to place said source inductor, said effective inductance of said inductive load, and said capacitor in parallel resonance for initially transferring energy stored in said capacitor to said effective inductance and establish a second current in said effective inductance, for resonant transfer to said source conductor; and closing said first switch across said source inductor when said energy in said effective inductance and in said capacitor is at a substantially zero level for retaining in said source inductor said energy transferred from said effective inductance.

9. A method according to claim 8 wherein said inductive load comprises a railgun having an effective inductance and a muzzle end for emitting a projectile, further including the step of:

closing said second switch when said projectile has reached a desired velocity.

* * * * *